US008689770B2

(12) United States Patent
Xin

(10) Patent No.: US 8,689,770 B2
(45) Date of Patent: Apr. 8, 2014

(54) HIGH-TEMPERATURE-FLOW ENGINE BRAKE WITH VALVE ACTUATION

(75) Inventor: Qianfan Xin, Lake Zurich, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 1171 days.

(21) Appl. No.: 12/610,841

(22) Filed: Nov. 2, 2009

(65) Prior Publication Data

US 2011/0100324 A1 May 5, 2011

(51) Int. Cl.
*F02D 13/00* (2006.01)
*F02D 13/04* (2006.01)
*F02D 9/06* (2006.01)

(52) U.S. Cl.
USPC ..... 123/322; 123/321; 123/323; 123/90.15; 701/103

(58) Field of Classification Search
CPC ..... F02D 13/00; F02D 13/02; F02D 13/04; F02D 9/06
USPC ..... 123/321, 322, 323, 90.15, 90.16, 90.17; 701/101, 102, 110, 112; 60/602
See application file for complete search history.

(56) References Cited

U.S. PATENT DOCUMENTS

| | | | | |
|---|---|---|---|---|
| 2001/0017033 | A1 * | 8/2001 | McKinley et al. | 60/605.2 |
| 2004/0093866 | A1 * | 5/2004 | Ishikawa | 60/605.2 |
| 2005/0045407 | A1 * | 3/2005 | Bulicz et al. | 180/309 |
| 2006/0005807 | A1 * | 1/2006 | Megli et al. | 123/322 |
| 2006/0081213 | A1 * | 4/2006 | Yang et al. | 123/321 |
| 2007/0084424 | A1 * | 4/2007 | Zurn | 123/27 R |

FOREIGN PATENT DOCUMENTS

| | | | | |
|---|---|---|---|---|
| JP | 60006026 A * | 1/1985 | | F02D 13/06 |

* cited by examiner

*Primary Examiner* — Stephen K Cronin
*Assistant Examiner* — Raza Najmuddin
(74) *Attorney, Agent, or Firm* — Jeffery P. Calfa; Mark C. Bach

(57) ABSTRACT

A control system and method for engine braking for a includes an engine braking control and at least one exhaust valve actuator responsive to demands from the braking control for causing the exhaust valve to open. The braking control is configured to command the exhaust valve actuator to substantially open and substantially close the exhaust valve at least twice during each engine cycle, a first event and a second event, when the pressure within the exhaust manifold is greater than the pressure in the cylinder. The braking control can also command the exhaust valve actuator to substantially open and substantially close during a third event between the first and second events.

12 Claims, 9 Drawing Sheets

HIGH-TEMPERATURE-FLOW ENGINE BRAKE WITH VALVE ACTUATION

TECHNICAL FIELD

This disclosure relates to vehicles, particularly large tractor trailer trucks, including but not limited to control and operation of an engine for engine braking.

BACKGROUND

Adequate and reliable braking for vehicles, particularly for large tractor-trailer trucks, is desirable. While drum or disc wheel brakes are capable of absorbing a large amount of energy over a short period of time, the absorbed energy is transformed into heat in the braking mechanism.

Braking systems are known which include exhaust brakes which inhibit the flow of exhaust gases through the exhaust system, and compression release systems wherein the energy required to compress the intake air during the compression stroke of the engine is dissipated by exhausting the compressed air through the exhaust system.

In order to achieve a high engine-braking action, a brake valve in the exhaust line may be closed during braking, and excess pressure is built up in the exhaust line upstream of the brake valve. For turbocharged engines, the built-up exhaust gas flows at high velocity into the turbine of the turbocharger and acts on the turbine rotor, whereupon the driven compressor increases pressure in the air intake duct. The cylinders are subjected to an increased charging pressure. In the exhaust system, an excess pressure develops between the cylinder outlet and the brake valve and counteracts the discharge of the air compressed in the cylinder into the exhaust tract via the exhaust valves. During braking, the piston performs compression work against the high excess pressure in the exhaust tract, with the result that a strong braking action is achieved.

Another engine braking method, as disclosed in U.S. Pat. No. 4,395,884, includes employing a turbocharged engine equipped with a double entry turbine and a compression release engine retarder in combination with a diverter valve. During engine braking, the diverter valve directs the flow of gas through one scroll of the divided volute of the turbine. When engine braking is employed, the turbine speed is increased, and the inlet manifold pressure is also increased, thereby increasing braking horsepower developed by the engine.

Other methods employ a variable geometry turbocharger (VGT). When engine braking is commanded, the variable geometry turbocharger is "clamped down" which means the turbine vanes are closed and used to generate both high exhaust manifold pressure and high turbine speeds and high turbocharger compressor speeds. Increasing the turbocharger compressor speed in turn increases the engine airflow and available engine brake power. The method disclosed in U.S. Pat. No. 6,594,996 includes controlling the geometry of the turbocharger turbine for engine braking as a function of engine speed and pressure (exhaust or intake, preferably exhaust). U.S. Pat. No. 6,148,793 describes a brake control for an engine having a variable geometry turbocharger which is controllable to vary intake manifold pressure. The engine is operable in a braking mode using a turbocharger geometry actuator for varying turbocharger geometry, and using an exhaust valve actuator for opening an exhaust valve of the engine.

Other methods of using turbochargers for engine braking are disclosed in U.S. Pat. Nos. 6,223,534 and 4,474,006.

In compression-release engine brakes, there is an exhaust valve event for engine braking operation. For example, in the "Jake" brake, such as disclosed in U.S. Pat. Nos. 4,423,712; 4,485,780; 4,706,625 and 4,572,114, during braking, a braking exhaust valve is closed during the compression stroke to accumulate the air mass in engine cylinders and is then opened at a selected valve timing somewhere before the top-dead-center (TDC) to suddenly release the in-cylinder pressure to produce negative shaft power or retarding power. The exhaust valve lift is shown in FIG. 1*a*.

In "Bleeder" brake systems, during engine braking, a braking exhaust valve is held constantly open during the entire engine cycle to generate a compression-release effect. The exhaust valve lift is shown in FIG. 1*b*.

According to the "EVBec" engine braking system of Man Nutzfahrzeuge AG, there is an exhaust secondary valve lift event induced by high exhaust manifold pressure pulses during intake stroke or compression stroke. The secondary lift profile is generated in each engine cycle and it can be designed to last long enough to pass TDC and high enough near TDC to generate the compression-release braking effect.

The EVBec engine brake is that it does not require a mechanical braking cam or variable valve actuation ("VVA") device to produce the exhaust valve braking lift events. The secondary valve lift is produced by closing an exhaust back pressure ("EBP") valve located at the turbocharger turbine outlet. When the engine brake needs to be deactivated, the EBP valve is set back to its fully open position to reduce the exhaust manifold pressure pulses during each engine cycle so that the exhaust valve floating and secondary lift as well as the braking lift event at TDC do not occur. It is assumed that there are no valve seating problems with the secondary valve lift event for this type of EVBec engine brake. Such a system is described for example in U.S. Pat. No. 4,981,119.

When operating the EVBec engine brake, when the turbine outlet EBP valve is very closed, turbine pressure ratio becomes very low, hence engine air flow rate becomes low. Also, engine delta P (i.e., exhaust manifold pressure minus intake manifold pressure) and exhaust manifold pressure may become undesirably high. As a result, the compression-release effect can be weakened, retarding power can be reduced, and in-cylinder component (e.g. fuel injector tip) temperature can become undesirably high.

The present inventor has recognized the desirability of providing a more effective engine braking system.

SUMMARY

An exemplary apparatus of the invention includes a control system for engine braking for a vehicle powered by an engine, the engine having a plurality of cylinders and an intake valve and an exhaust valve associated with at least one of the cylinders, the intake valve opening the cylinder to an intake manifold and the exhaust valve opening the cylinder to an exhaust manifold. The control system includes an engine braking control, at least one exhaust valve actuator responsive to demands from the braking control for causing the exhaust valve to open, and at least one exhaust back pressure (EBP) valve selectively restricting exhaust gas from flowing from the exhaust manifold to ambient. The EBP valve is in signal-communication with the braking control. The braking control is configured to command the exhaust valve actuator to substantially open and substantially close the exhaust valve at least twice during each engine cycle, a first event and a second event, when the pressure within the exhaust manifold is greater than the pressure in the cylinder.

According to another embodiment, the braking control is also configured to command the exhaust valve actuator to substantially open and substantially close during a third event between the first and second events.

More particularly, the engine can be a four stroke engine wherein a crankshaft rotates 720 degrees for each complete cycle, with 0 degrees being top dead center ("TDC"). According to one embodiment, the braking control is configured to command the exhaust valve actuator to cause the exhaust valve to substantially open and substantially close for the first event during some part of the cycle between crank angles of 500 and 630 degrees and to cause the exhaust valve to substantially open and substantially close for the second event during some part of the cycle between crank angles of 630 and 90 degrees. According to an enhancement, the braking control can also be configured to command the exhaust valve actuator to cause the exhaust valve to substantially open and substantially close during some part of the cycle between crank angles of 360 and 500 degrees, as a third event.

According to another embodiment, the engine is a four stroke engine wherein a crankshaft rotates 720 degrees for each complete cycle, and 0 degrees is TDC. The braking control is configured to command the exhaust valve actuator to cause the exhaust valve to substantially open and substantially close for a first event during some part of the cycle between crank angles of 360 and 500 degrees and cause the exhaust valve to substantially open and substantially close for a second event during some part of the cycle between crank angles of 630 and 90 degrees.

The at least one exhaust valve can comprise a valve spring for holding the valve closed with a pre-load spring force and the exhaust valve actuator comprises a counter-preload device for selectively exerting a counter force to the spring pre-load force to assist in opening the valve.

The exhaust valve actuator can comprise: a mechanical cam, an electronically-controlled pneumatic device, an electronically-controlled hydraulic device, or an electro-magnetic actuator.

The exhaust valve actuator can be configured to be a two-way actuator, to exert selectable opposing forces on the valve to urge either opening or closing of the valve.

An exemplary method of the invention for engine braking in a vehicle powered by an engine, the engine having a plurality of cylinders and an intake valve and an exhaust valve associated with at least one of the cylinders, the intake valve opening the cylinder to an intake manifold and the exhaust valve opening the cylinder to an exhaust manifold, includes the steps of:

selectively restricting exhaust gas from flowing from the exhaust manifold to ambient to increase exhaust back pressure in the exhaust gas manifold;

during each engine cycle, substantially opening and substantially closing the exhaust valve twice, a first event and a second event, when the pressure within the exhaust manifold is greater than the pressure in the cylinder.

The method can include the further step of substantially opening and substantially closing the exhaust valve during a third event between the first and second events.

For an engine that is a four stroke engine wherein a crankshaft rotates 720 degrees for each complete cycle, and 0 degrees is TDC, the steps of substantially opening and substantially closing the exhaust valve can be further defined in that the first event occurs during some part of the cycle between crank angles of 500 and 630 degrees and the second event occurs during some part of the cycle between crank angles of 630 and 90 degrees. Alternately, the first event can occur between crank angles of 360 and 500 degrees. Alternately still, the first event can occur between crank angles of 500 and 630 degrees, the second event occurs during some part of the cycle between crank angles of 630 and 90 degrees and a third event can occur between the first and second event, between 360 and 500 degrees.

The exemplary method and apparatus of the invention provide engine braking enhancements, such as:

(1) A method of using engine exhaust valve events to increase engine air flow rate and exhaust manifold gas temperature simultaneously to enhance compression-release effect in engine braking;

(2) A device to achieve ultra-low net spring preload used in engine braking operation to regulate the exhaust-pulse-induced secondary braking valve event; and (3) A method of using engine exhaust valve events to alter volumetric efficiency, engine delta P and engine-turbocharger matching during engine braking to enhance retarding power and enabling different engine brake design strategies.

The exemplary methods and apparatus of the invention increases engine retarding power without introducing other difficulties related to engine brake design constraints. Simulation predict that engine retarding power can be more than doubled according to an exemplary method of the present invention.

The exemplary method and apparatus of the present invention can also be used in the "EVBec" type of engine brakes to use a ultra-low net spring preload device to increase or regulate the secondary exhaust braking valve lift event to increase or regulate retarding power.

The exemplary method of the invention increases engine air flow rate for naturally aspirated engines and turbocharged engines or increases both engine air flow rate and exhaust manifold temperature for turbocharged engines in order to increase engine retarding power.

The exemplary apparatus of the invention can include electronic controls, one or more controllable exhaust gas valves, and an exhaust back pressure (EBP) valve. The controllable exhaust gas valve can be controlled by a counter-spring preload actuator, such as an electromechanical device. The EBP valve can be a flap valve or exhaust gas throttle valve, and can be located at the turbine outlet.

Numerous other advantages and features of the present invention will be become readily apparent from the following detailed description of the invention and the embodiments thereof, from the claims and from the accompanying drawings.

DETAILED DESCRIPTION

Figure 1B:
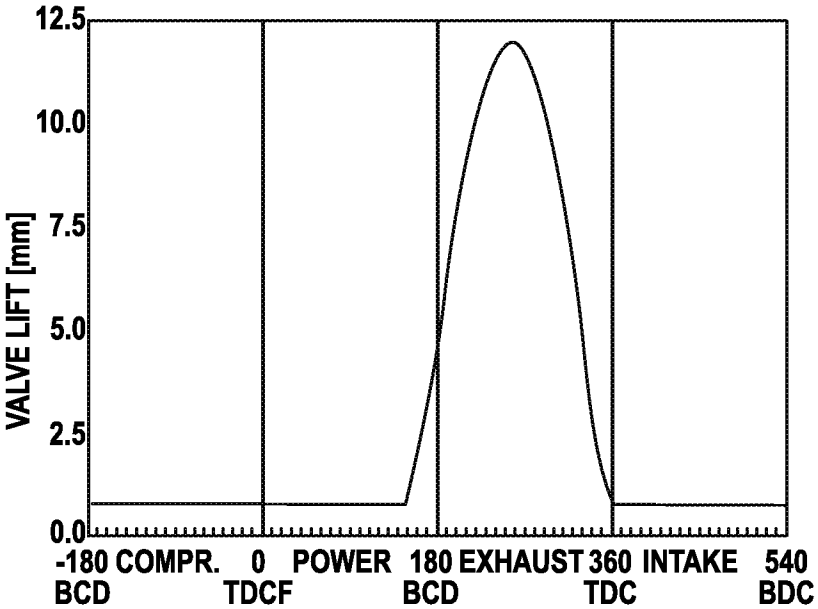
FIG. 1b PRIOR ART
FIG. 1*b* is a graph of exhaust valve lift versus crank angle for a prior art Bleeder Brake.
Figure 1A:
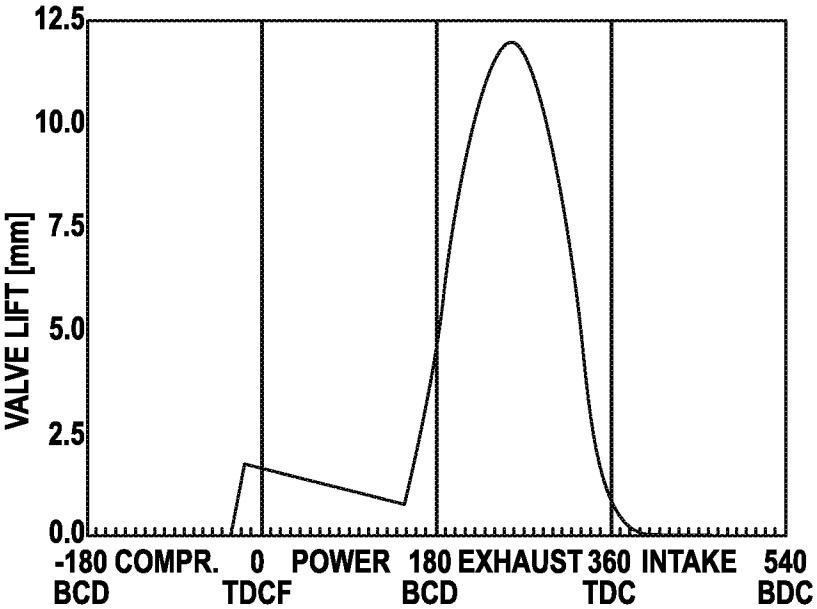
FIG. 1a PRIOR ART
FIG. 1*a* is a graph of exhaust valve lift versus crank angle for a prior art Jake Brake.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

In compression-release engine brakes, the retarding power consists of two parts: the compression-release effect and the contribution from pumping loss. The pumping loss consists of the contributions from engine delta P, mainly related to turbine effective area, and engine volumetric efficiency, mainly affected by valve timing/event. The compression-release effect is related to the exhaust braking valve event/timing/lift near TDC and engine air flow rate or the air mass trapped near TDC. For a properly designed exhaust braking valve event/timing/lift near TDC, when engine air flow rate is higher, the compression-release effect is stronger hence the engine retarding power is higher. Therefore, retarding power is enhanced by increasing engine air flow rate within the design constraints.

For turbocharged engines, air flow rate is related to volumetric efficiency, intake manifold pressure and turbine power, which is affected by turbine effective area, exhaust manifold pressure, turbine outlet pressure and exhaust manifold gas temperature. Engine air flow rate is also related to exhaust manifold temperature through the in-cylinder cycle process. In general, the lower the air flow rate, the higher the exhaust manifold temperature. Increasing turbine outlet pressure causes a reduction in turbine power and air flow rate.

A conventional way to increase engine air flow rate is to use a smaller turbine nozzle or various back pressure valve controls around the turbine to let the turbine spin faster, for example, closing a back pressure valve at the turbine inlet or opening a back pressure valve at the turbine outlet.

According to the exemplary method of the present invention, turbine power or air flow rate is increased by using increased exhaust manifold temperature, i.e., transferring the thermal energy to the turbine inlet. By using hot exhaust manifold gas, collecting the gas, enhancing the gas by an in-cylinder gas compression process and then releasing the gas to drive the turbine, the turbine will spin faster and deliver higher air flow rate to enhance the compression-release effect and retarding power. Therefore, simultaneously providing high exhaust manifold temperature and air flow rate is one enhancement of the exemplary method of the present invention.

According to the exemplary method of this invention, in the late intake stroke and early compression stroke, there is such a source of hot exhaust gas which can be inducted from the exhaust manifold into the engine cylinder by using additional exhaust valve events, in addition to the conventional braking valve event near TDC, when exhaust port pressure is higher than in-cylinder pressure. Not only is additional air mass inducted during this process, the additional air mass is hot, and it is compressed by the piston to reach even hotter temperature and higher cylinder pressure before it is released to the turbine inlet. Therefore, the valve event not only induces stronger blow-down during the compression-release process of engine braking, but also transfers higher thermal energy to the turbine inlet. This energy ultimately comes from the vehicle power to be resisted.

The resulting compounding effect of high air flow and temperature enhances engine retarding power. Although the in-cylinder temperature and exhaust manifold temperature are hot in the exemplary apparatus of the present invention, because the air flow rate is high, the in-cylinder temperature and exhaust manifold temperature are usually not excessively high to violate the design constraints.

Figure 2A:
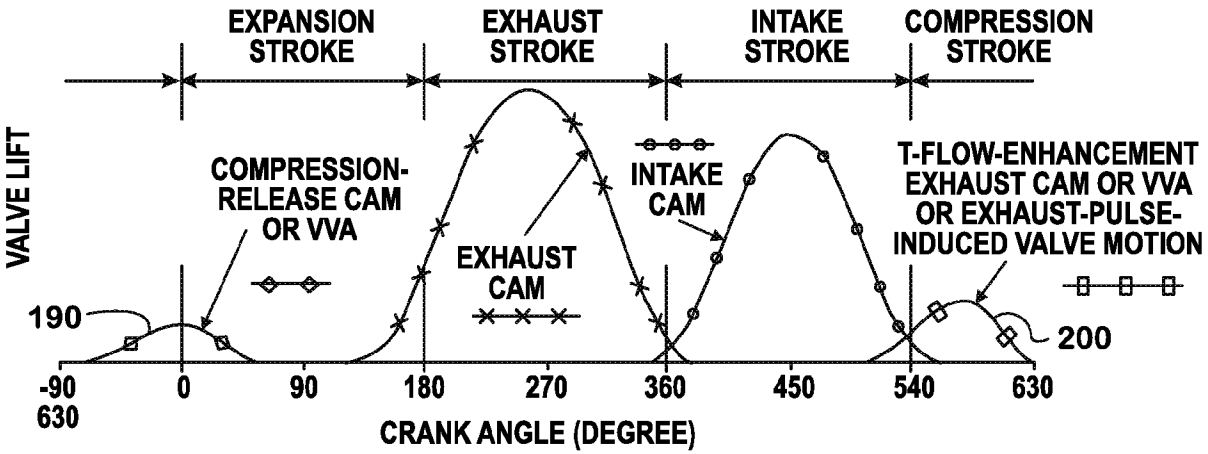
FIG. 2*a* is a graph of exhaust valve lift versus crank angle according to a first exemplary method of the invention.

FIG. 2*a* shows the exhaust valve events used according to an exemplary method of the invention. This graph is for a four stroke engine wherein each engine cycle corresponds to a 720 degree rotation of the crankshaft. A compression release event is represented by the graph portion 190. This portion 190 opens the valve just before TDC and the compression release exhaust valve event, a substantial opening and closing of the exhaust valve, occurs between crank angles 630 and 90 degrees. A temperature-flow-enhancement ("T-flow-enhancement") exhaust valve event, a substantial opening and closing of the exhaust valve, is represented by the graph portion 200. The events 190, 200 can be generated by any of the following: mechanical cams, variable valve actuation devices, or exhaust-manifold-pressure-pulse-induced free motion of the exhaust valve. The exhaust-manifold-pressure-pulse-induced free motion of the exhaust valve can be accomplished for example by one or more of the following methods: closing an EBP valve placed at turbine outlet; closing an EBP valve placed at turbine inlet; closing turbine vanes in a variable geometry turbine; and/or closing a turbine wastegate of a small turbine. Each valve event can be a single event or multiple events.

According to the exemplary method of the invention, the addition of the event 200 boosts both air flow and exhaust manifold gas temperature. For different engines (I4, I6, divided or undivided turbine entry or exhaust manifold, etc.) and at different speed, the exhaust port pressure pulsation can be different, and the effective location of the T-flow-enhancement exhaust valve event 200 can be different accordingly. For four-stroke engines, the effective valve timing is the crank angle durations in late intake stroke and early compression stroke where the intake valve is almost closed and exhaust port pressure is higher than in-cylinder pressure.

Figure 2B:
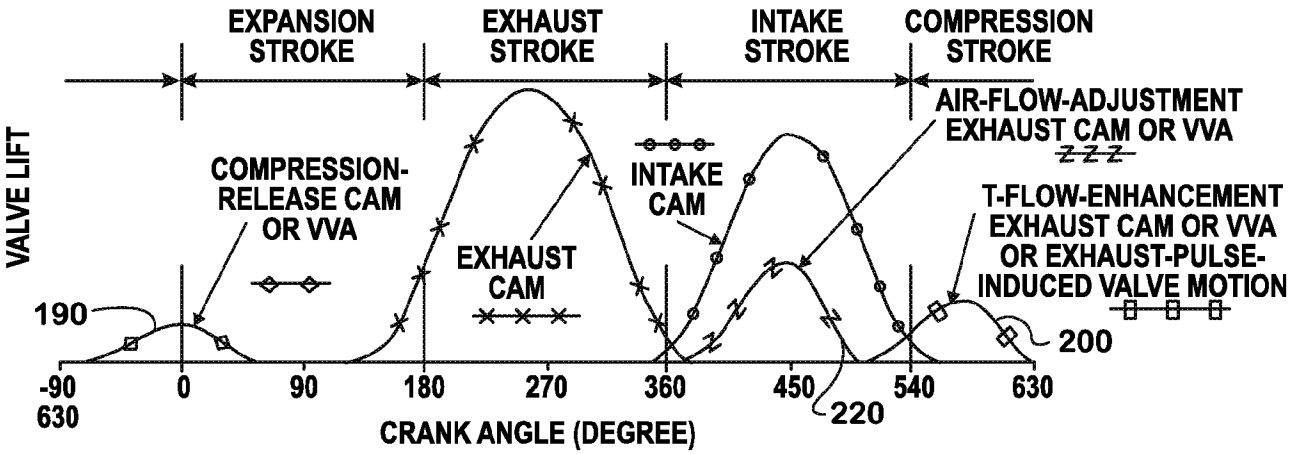
FIG. 2*b* is a graph of exhaust valve lift versus crank angle according to a second exemplary method of the invention.

FIG. 2*b* shows a further enhancement provided according to an exemplary method of the present invention, the "air-flow-adjustment" exhaust valve event or "third valve event" during intake stroke. This third valve event is represented by the graph portion 220. Turbocharger power and intake air boost pressure are affected by turbocharger efficiency and the position of engine operating point on the compressor map. The position can be changed by engine volumetric efficiency and exhaust valve events. Adding a third exhaust valve lift event in intake stroke during engine braking may affect the intake air flow and volumetric efficiency by the pressure differential between exhaust port and intake port. Therefore, engine delta P may be reduced and meanwhile high retarding power can be maintained. Low engine delta P sometimes is desirable for engine design constraints.

This third valve event alters engine volumetric efficiency significantly during engine braking, and hence is able to adjust engine delta P. Simulation shows that low volumetric efficiency (e.g., 52%) plus low engine delta P (e.g., 2.5 bar) does give lower total pumping loss than the case of high volumetric efficiency (80%) plus high engine delta P (4.7 bar). The valve event may also change the position of the engine braking operating points on compressor map for turbocharged engines so that the engine can run at desirable compressor efficiency.

Figure 2C:
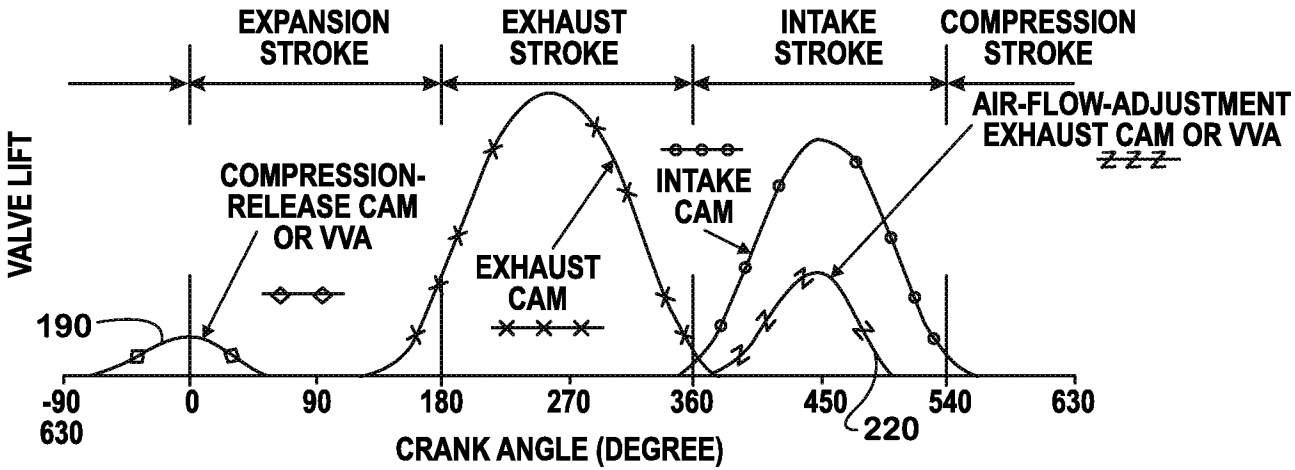
FIG. 2*c* is a graph of exhaust valve lift versus crank angle according to a third exemplary method of the invention.

FIG. 2*c* illustrates a further embodiment wherein the T-flow-enhancement exhaust valve event 200 of FIG. 2*b* is eliminated and only the events 190 and 220 are used.

Figure 3:
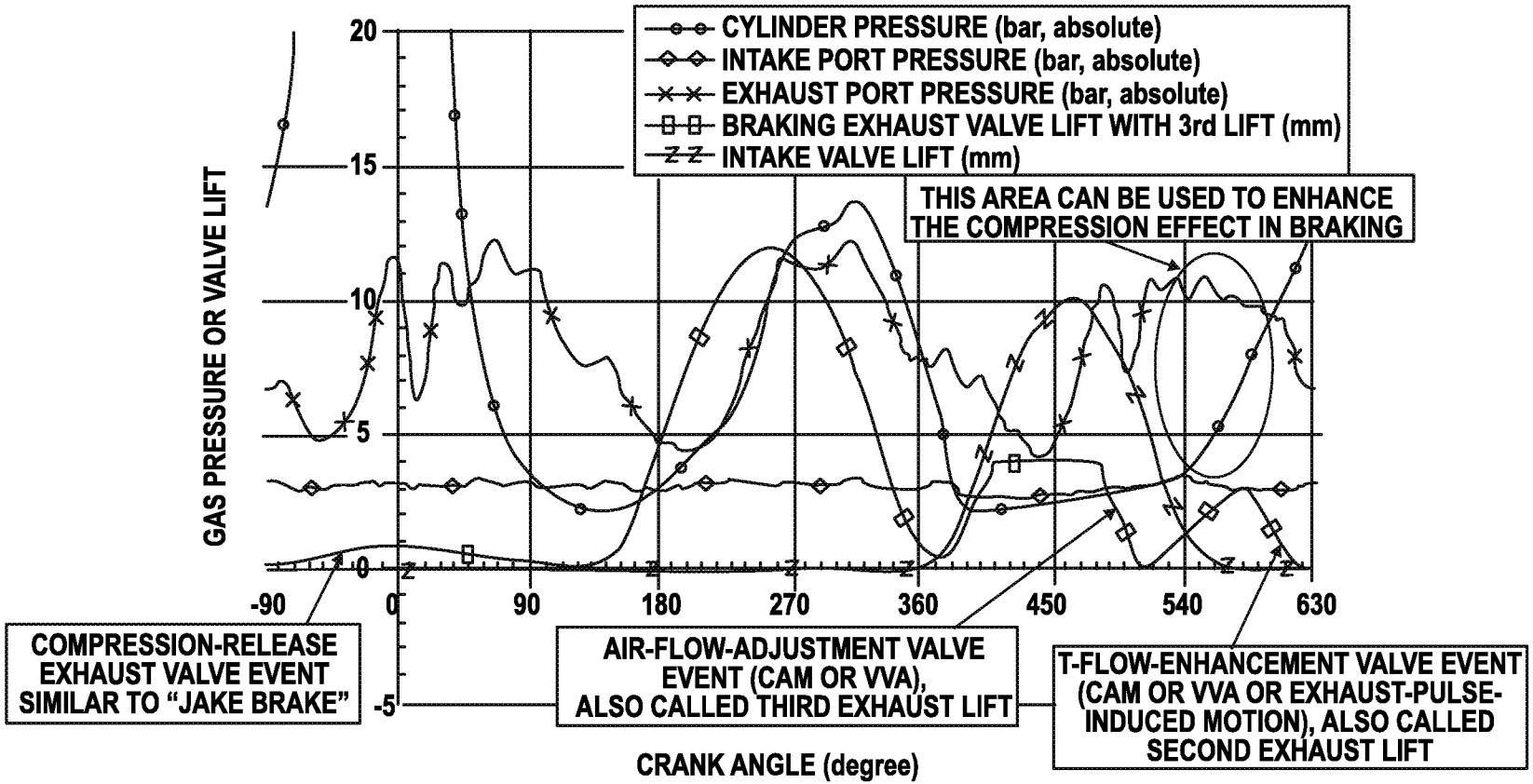
FIG. 3 is modeled result of the second exemplary method of the braking system of the present invention.
Figure 4:
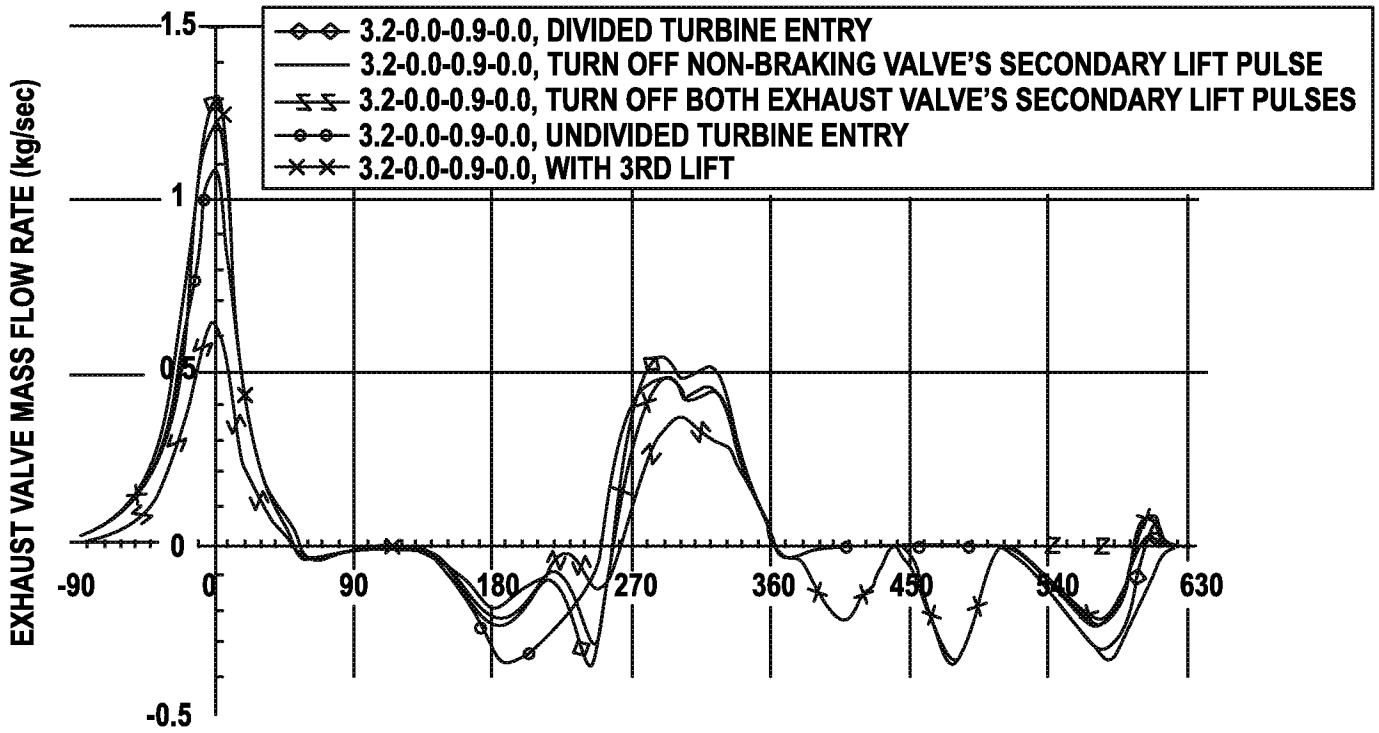
FIG. 4 is a comparison graph of valve flow rates versus crank angle of different engine braking methods.
Figure 5:
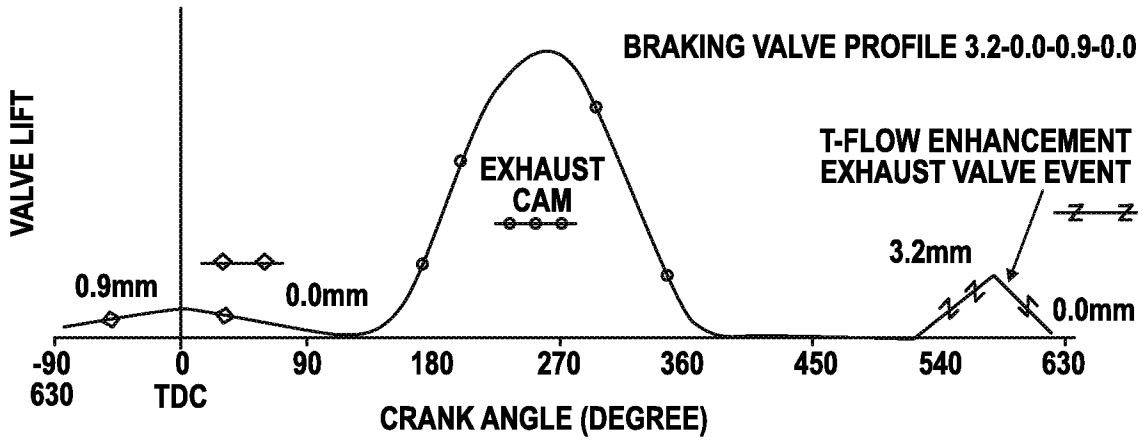
FIG. 5 is a graph of an alternate exhaust valve lift versus crank angle according to an exemplary method of the invention.

The "air-flow-adjustment" exhaust valve event shown in FIGS. 2*b* and 2*c* enhance engine brake performance and enable the design functions associated with different design strategies of engine delta P and turbocharger matching during braking The exhaust valve event timing to alter engine delta P and volumetric efficiency occur at the crank angle durations in intake stroke where the exhaust port pressure is higher than intake port pressure and part of the exhaust flow can flow reversely into the intake port, i.e., around 360-510 degree crank angle after the firing TDC, shown in FIGS. 3-4.

Figure 6:
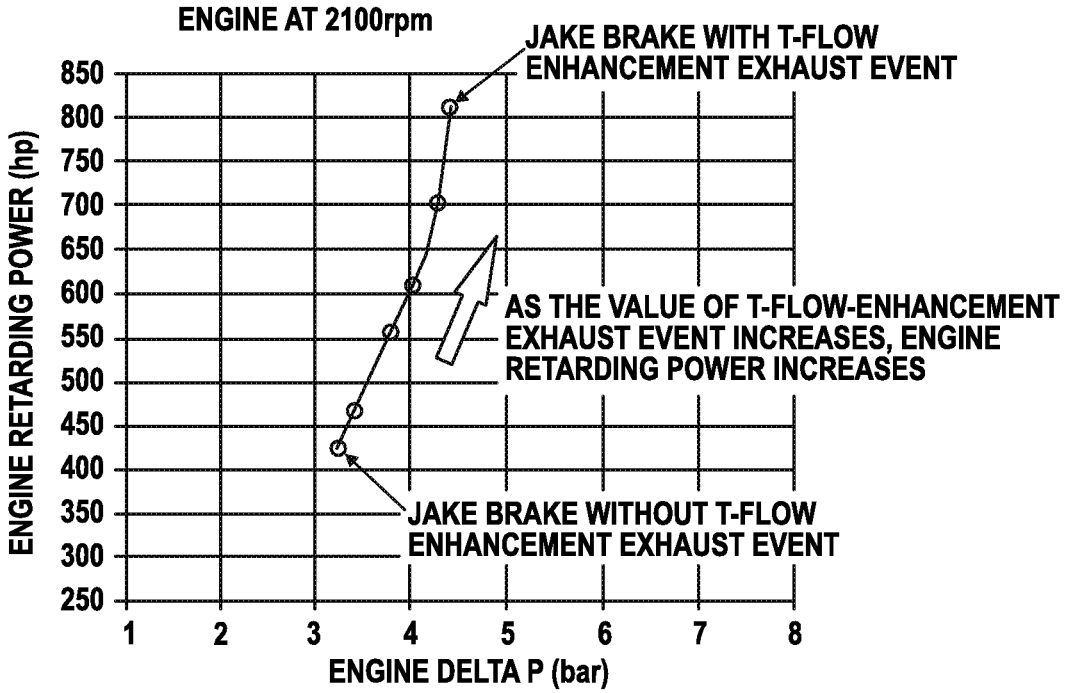
FIG. 6 is a comparison graph of engine retarding power versus difference in pressure between the exhaust manifold pressure and the intake manifold pressure of different engine braking methods.

The exemplary method of the invention increases engine retarding power, demonstrated by the simulation data graphed in FIG. 6. At 2100 rpm for a 12.4 L engine, a significant retarding power increase from the traditional Jake brake is demonstrated by the two endpoints of the graph in FIG. 6.

The exemplary methods and apparatus of the invention increases engine retarding power without introducing other difficulties related to engine brake design constraints. Simulation shows that engine retarding power can be more than doubled according to an exemplary method of the present invention.

For the T-flow-enhancement valve event and/or for an air-flow-adjustment exhaust valve event, a mechanical cam, or VVA valve events, or regulated exhaust-manifold-pressure-pulse-induced braking valve motion with a secondary exhaust valve lift event can be utilized.

Engine retarding power is affected by the size and the location of the secondary valve lift event of the braking exhaust valve. For the exhaust-manifold-pressure-pulse-induced floating motion of the exhaust braking valve, the secondary lift height is affected by valve weight, valve stem diameter, net valve spring preload and the pressure differential between exhaust port pressure and in-cylinder pressure. Using a light brake valve (e.g., hollow valve or low-density material), a small valve stem diameter, a low net spring preload or increasing pressure differential pulsation by manifold tuning may be effective design methods to increase the secondary lift size to recover exhaust gas energy to put into the turbine inlet to spin the turbo faster in order to boost air flow and retarding power.

Figure 7:
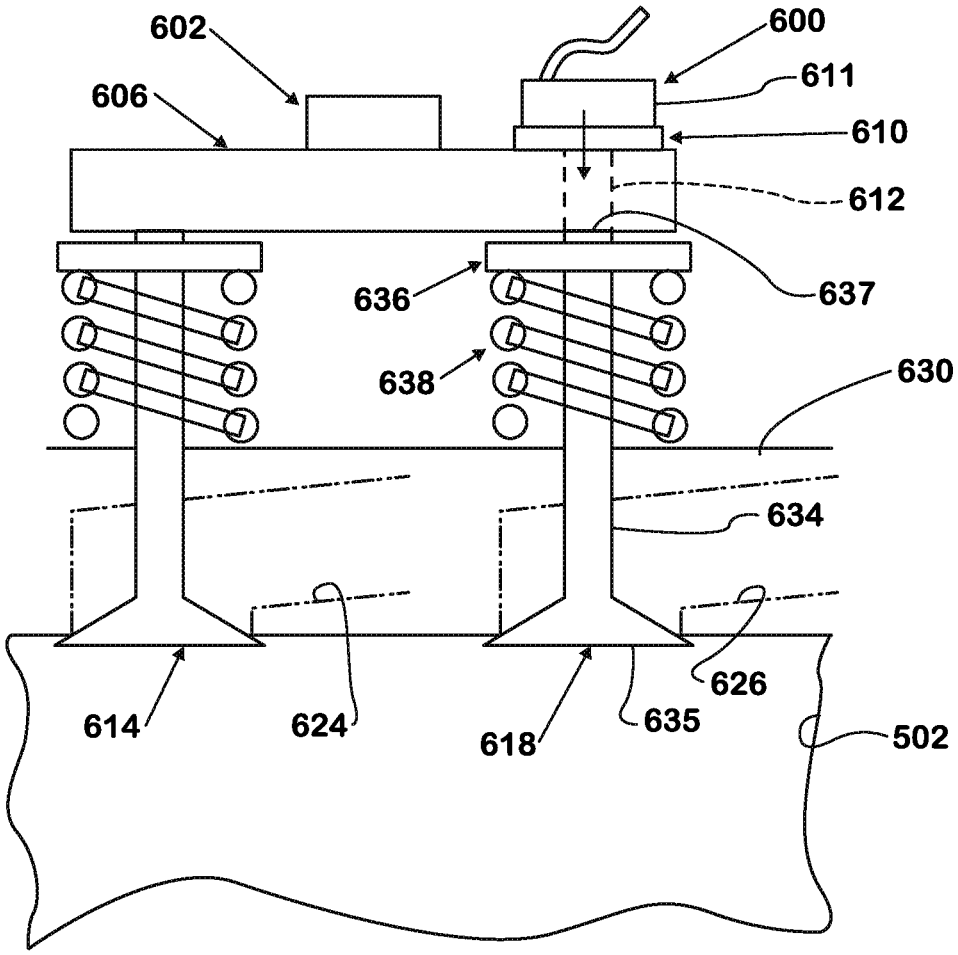
FIG. 7 is a schematic side view of an exhaust valve system according to an exemplary apparatus of the invention.

FIG. 7 shows a device for ultra-low net valve spring preload (either on/off type of variable) used in the engine brake with exhaust-manifold-pressure-pulse-induced valve motion. The device may reduce the net spring preload to enable high retarding power at very low engine speed because with very low (or even zero) net preload the exhaust braking valve may float easily to generate a high secondary valve lift to recover more exhaust gas mass from exhaust manifold to cylinder to enable the high-temperature-flow operation of the engine brake through a faster spinning turbine. The variable net valve spring preload device can also adjust retarding power continuously by regulating the size of exhaust secondary valve lift event. Moreover, the variable net valve spring preload device, if designed with electro-magnetic means, may be used to totally or partially deactivate the engine brake by applying an attractive magnetic force on the top of the braking valve to increase the net spring preload to stop the secondary lift event.

FIG. 7 illustrates a device for ultra-low net spring preload, either an on/off type or variable type, used in engine braking operation. FIG. 7 shows an exemplary pre-load system 600 for ultra-low net valve spring preload. Identical devices can be used at all cylinders or some of the cylinders, of the engine, although only the system 600 at the cylinder 502 is shown. The system 600 includes a rocker arm 602, a valve bridge 606, a counter-preload device 610, a normally operated exhaust valve 614 and an exhaust brake valve 618. The valves 614 and 618 open the cylinder 502 to the exhaust manifold via exhaust gas passages 624, 626 provided in a cylinder head 630.

Each valve includes a stem 634, a head 635, a spring keeper 636, and an end 637. A valve spring 638 surrounds the stem 634 and is fit between the keeper 636 and the cylinder head 630. To move the heads 635 away from valve seats 640, 642 during normal engine operation, at the selected crankshaft angle, the rocker arm 602 presses the valve bridge 606 down to move the valve stems 634 down via force on the ends 637 against the expansion force of the springs 638 as the springs are being compressed between the keepers 636 and the cylinder head 630.

During an engine braking operation, differential pressure across the head 635 of the valve 618 moves the head 635 down and away from the valve seat 642 and exhaust gas can enter the cylinder 502. In this regard the valve is a "floating exhaust valve" in that differential pressure across the valve is sufficient to "lift" the valve downward away from its seat. The differential pressure is the difference between exhaust gas backpressure within the passage 626 and the pressure within the cylinder 502. This differential pressure must also be sufficient to overcome the expansion force of the spring 638 as the opening of the valve 618 compresses the spring 638.

The counter-preload device or actuator 610 is shown installed on top of the valve bridge 606. The net valve spring preload refers to the total resultant force on the normal spring preload and the opposing force exerted by the counter-preload device. The counter-preload device 610 can provide engine brake activation and deactivation controls and the ability of achieving variable "net" spring preload to obtain variable or higher retarding power during engine braking operation. The device 610 can be variable or strictly off and on. The device 610 includes an actuator portion 611 that transmits a downward force via a force rod 612 that is pressed against the end 637 of the valve 618. Alternately, the force rod 612 can be operatively connected to the valve shaft 634 so that the actuator portion can exert a selectable two way force (up or down) on the valve 618. In this way the device can act to assist the spring 638 in closing the valve in addition to acting as a counter-pre-load to open the valve. It is also possible that the device configured as a two way force acting device can eliminate the need for the spring.

The counter-preload device 610 can be embodied as one of the following non-exhaustive list of devices:

- a displacement device such as a mechanical cam driven by certain torque to lift the valve just off the valve seat to offset the normal spring preload; or
- another spring to exert an opposing mechanical force; or
- an electronically controlled pneumatic force device using an air source from the engine; or
- an electronically controlled hydraulic force device using engine oil or other working fluid; or
- a one-way (expelling) or two-way (expelling and attracting) electro-magnetic force device to provide opposing or additional force to reduce or increase net spring preload to make the net preload completely variable.

The device may reduce the net spring preload to enable the brake to operate at very low engine speed because with very low net preload the exhaust braking valve may float easily off its valve seat to generate a secondary valve lift for braking Moreover, the device can make the secondary lift very high to recover more exhaust gas mass from exhaust manifold to cylinder to enable the high-flow-temperature operation of the engine brake through a faster spinning turbine.

The variable net valve spring preload device can also adjust retarding power continuously by regulating the size of exhaust secondary valve lift event.

Figure 8:
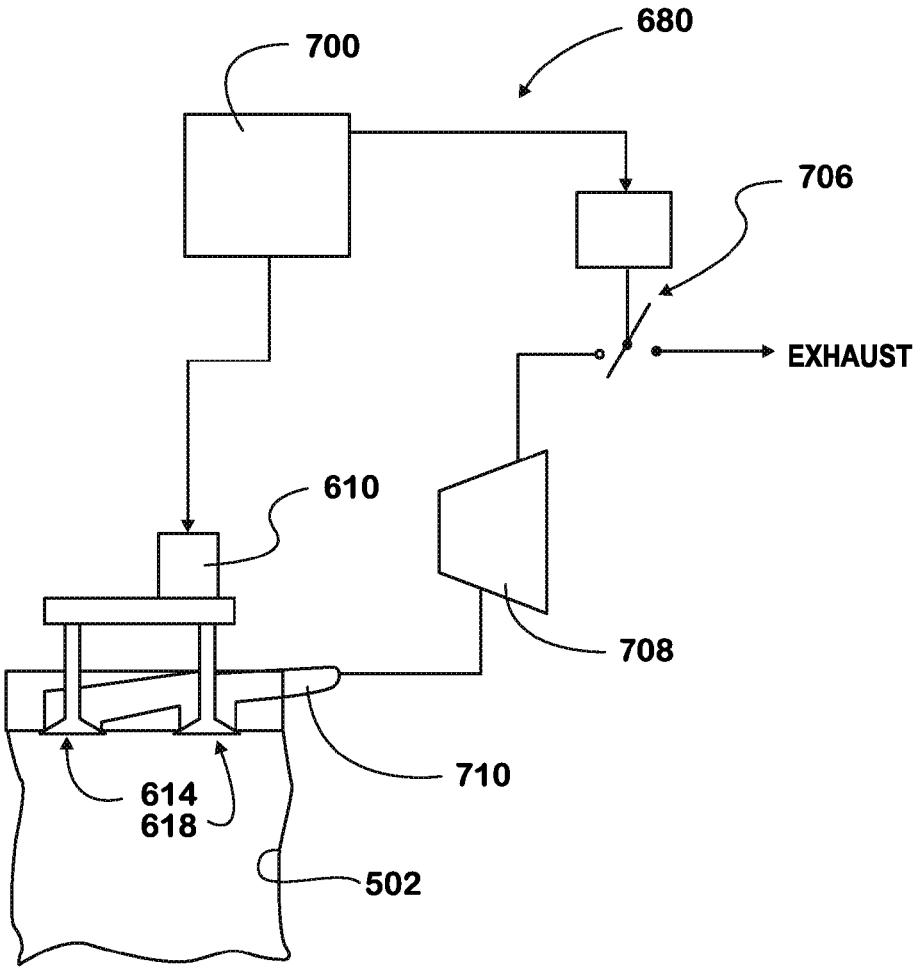
FIG. 8 is a schematic diagram of an engine braking system according to an exemplary apparatus of the invention.

FIG. 8 illustrates a simplified schematic of an engine braking control system 680. An engine braking control 700 is signal-connected to a downstream EBP valve 706 which, by closing, can increase backpressure through a turbocharger turbine 708 and back through an exhaust gas manifold 710. The control is also signal-connected to the counter-preload device 610 to allow the valve 618 to be opened by differential pressure between the exhaust manifold 710 and pressure within the cylinder 502. The control 700 can initiate exhaust-manifold-pressure-pulse-induced valve motion by commanding the EBP valve 706 to close to a specified degree and also increasing the counter-preload force on the valve 618 by commanding an increase in counter-preload force by the device 610.

Although the EBP valve 706 is shown downstream of the turbine 708, it is possible that the EBP valve could be located upstream of the turbine 708. It is also possible that turbine vanes in a variable geometry turbine can be at least partly closed or restricted or a turbine wastegate of a small turbine could be at least partly closed, to raise exhaust back pressure.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A control system for engine braking for a vehicle powered by an engine, the engine having a plurality of cylinders and an intake valve and an exhaust valve associated with at least one of the cylinders, the intake valve opening the cylinder to an intake manifold and the exhaust valve opening the cylinder to an exhaust manifold, the control system comprising:

an engine braking control;

at least one exhaust valve actuator responsive to demands from the braking control for causing the exhaust valve to open; and the braking control being configured to command the exhaust valve actuator to substantially open and substantially close the exhaust valve at least three times during each engine cycle when the pressure within the exhaust manifold is greater than the pressure in the cylinder, a first braking event, a second braking event, and a third braking event;

the exhaust valve also being substantially opened and closed during each cycle for release of exhaust gases in the exhaust stroke of the engine;

wherein the engine is a four stroke engine wherein a crankshaft rotates 720 degrees for each complete cycle, and 0 degrees is TDC, the braking control is configured to command the exhaust valve actuator to cause the exhaust valve to substantially open and substantially close for the first braking event during some part of the cycle between crank angles of 500 and 630 degrees, and cause the exhaust valve to substantially open and substantially close for the second braking event during some part of the cycle between crank angles of 630 and 90 degrees, wherein the braking control is also configured to command the exhaust valve actuator to cause the exhaust valve to substantially open and substantially close for the third braking event during some part of the cycle between crank angles of 360 and 500 degrees.

2. The control system according to claim 1, wherein the at least one exhaust valve comprises a valve spring for holding the valve closed with a pre-load spring force and the exhaust valve actuator comprises a counter-preload device for selectively exerting a counter force to the spring pre-load force to assist in opening the valve.

3. The control system according to claim 1, wherein the exhaust valve actuator comprises one device selected from the group consisting of: a mechanical cam, an electronically-controlled pneumatic device, an electronically-controlled hydraulic device, and an electro-magnetic actuator.

4. The control system according to claim 1, wherein the exhaust valve actuator comprises an electro-magnetic actuator.

5. The control system according to claim 4, wherein the electro-magnetic actuator can exert selectable opposing forces on the valve to urge either opening or closing of the valve.

6. The control system according to claim 1, wherein said at least one exhaust valve actuator comprises a variable valve actuator that is electronically controlled and operates on the at least one exhaust valve by pneumatic or hydraulic fluid during braking.

7. The control system according to claim 1, wherein said at least one exhaust valve actuator is electronically controlled and operates on the at least one exhaust valve by magnetic force during braking.

8. The control system according to claim 1, comprising an exhaust back pressure (EBP) valve located in an exhaust conduit downstream of the exhaust manifold, the braking control commanding the EBP valve to be more closed to raise exhaust back pressure during braking.

9. The control system according to claim 8, comprising a turbine downstream of the exhaust manifold and wherein the EBP valve is located downstream of the turbine.

10. The control system according to claim 8, comprising a turbine downstream of the exhaust manifold and wherein the EBP valve is located upstream of the turbine.

11. The control system according to claim 1, comprising a turbine downstream of the exhaust manifold and wherein the turbine is a variable geometry turbine, wherein the braking control commands vanes of the variable geometry turbine to be more closed to increase exhaust back pressure during braking.

12. The control system according to claim 1, comprising a turbine downstream of the exhaust manifold and a controllable wastegate that bypasses exhaust gas around the turbine, wherein the braking control commands the wastegate to be more closed to increase exhaust back pressure during braking.

* * * * *